United States Patent [19]

Wallace, Jr.

[11] B 3,985,960

[45] Oct. 12, 1976

[54] STEREOPHONIC SOUND REPRODUCTION WITH ACOUSTICALLY MATCHED RECEIVER UNITS EFFECTING FLAT FREQUENCY RESPONSE AT A LISTENER'S EARDRUMS

[75] Inventor: Robert Lee Wallace, Jr., Warren Township, Somerset County, N.J.

[73] Assignee: Bell Telephone Laboratories, Incorporated, Murray Hill, N.J.

[22] Filed: Mar. 3, 1975

[21] Appl. No.: 554,594

[44] Published under the second Trial Voluntary Protest Program on January 20, 1976 as document No. B 554,594.

[52] U.S. Cl. ..... 179/1 G; 179/107 E; 179/182 R; 179/147

[51] Int. Cl.[2] ..... H04R 1/02; H04R 5/00

[58] Field of Search..... 179/1 G, 1 D, 1 C, 175.1 A, 179/107 E, 121 R, 121 D, 182 R, 100.4 C, 153, 147

[56] References Cited

UNITED STATES PATENTS

| | | | |
|---|---|---|---|
| 2,363,175 | 11/1944 | Grossman | 179/107 R |
| 2,849,533 | 8/1958 | Di Mattia | 179/107 E |
| 3,157,750 | 11/1964 | Weingartner | 179/115.5 R |
| 3,558,833 | 1/1971 | McCrory | 179/175.1 A |
| 3,798,393 | 3/1974 | Gorike | 179/182 |
| 3,890,474 | 6/1975 | Glicksberg | 179/107 E |

OTHER PUBLICATIONS

"An Ear-Like Coupler—," by Zwislocki, Apr., 1971, Special Report LSC-S-9.

*Primary Examiner*—Douglas W. Olms
*Attorney, Agent, or Firm*—W. Ryan; A. E. Hirsch

[57] ABSTRACT

A binaural sound recording and reproduction system which utilizes a recording mannequin equipped with an electroacoustic model of the human auditory tract to thereby record the sound pressure which would be incident on a listener's eardrum and also utilizes a headset with in-ear transducers or receivers which exhibit a flat frequency response as measured at the listener's eardrums is described. The receiver units utilize acoustic impedance matching to the listener's ear canal to effect the flat frequency response characteristic. An electrical equalizer circuit to facilitate the use of the subject in-ear receivers with conventionally recorded sound is also disclosed.

14 Claims, 7 Drawing Figures

STEREOPHONIC SOUND REPRODUCTION WITH ACOUSTICALLY MATCHED RECEIVER UNITS EFFECTING FLAT FREQUENCY RESPONSE AT A LISTENER'S EARDRUMS

BACKGROUND OF THE INVENTION

This invention relates to the binaural reproduction of sound. More particularly, this invention relates to apparatus for the precise reproduction or transmission of sound so that the sound waves which reach the listener's eardrum are substantially identical to those reaching the eardrums of the persons actually present within the originating sound field.

Apparatus and techniques for the faithful reproduction of sound have been the subject of a great deal of development effort throughout the past few decades. The benefits of high-quality sound reproduction have become well known and include increased listening pleasure of musical compositions and increased intelligibility of oral communications under difficult circumstances such as speakers who are located in extremely noisy environments.

In the area of recording and reproducing musical entertainment alone, many significant changes have occurred in the past few years. The monophonic high-fidelity systems of the 1950's have been largely supplanted by the stereophonic techniques of the 1960's which, along with the increasingly popular four-channel or quadraphonic systems, form the present-day quality sound system. Although each system has demonstrated an advance over the preceding systems, complete realism has not been achieved by currently available apparatus, and those within the art continually strive to achieve sound reproduction which, in effect, places the listener in the audience.

One recent stereophonic system of interest attempts to produce electrical signals which faithfully represent what a person actually located in the sound field of interest would hear by utilizing microphones positioned to duplicate the human ears. In some instances, the microphones have been actually placed on or encased in a mannequin or model of a head in an attempt to capture the sound as it is actually heard by a physically present listener, influenced by head and ear size, bone construction, and other factors. If the signal recorded by such a system is reproduced in a quality stereo apparatus and presented to the listener by means of a stereophonic headset, a marked improvement in directionality is observed, that is, the listener's ability to determine the relative location of each particular sound source contributing to the overall recorded sound field is enhanced. This improvement in directionality, in turn, imparts the sensation of greater realism. For example, where the reproduced sound is musical entertainment, the listener's sense of impression as to the localization of each musical instrument and each voice is greatly improved, and where the reproduced sound is speech in which there is either a high background noise level or several speakers engaging in rapid conversational exchange, the listener's ability to ascertain what is said by a speaker is significantly enhanced. Although this prior art system has demonstrated improved directionality and realism, it has not achieved that degree of improvement over more conventional recording and reproduction systems required to create widespread interest and application.

Accordingly, it is an object of this invention to provide a binaural sound reproduction system which exhibits greater realism and directionality characteristics than those exhibited by the prior art.

It is a further and more specific object of this invention to utilize recent advances in the understanding of the human auditory tract to realize a system in which the recorded sound is representative of the sound pressure developed at a listener's eardrum, rather than the sound pressure which would impinge on the outer ear, and to realize a novel in-ear transducer or receiver unit which exhibits a flat frequency response as measured at the listener's eardrums.

SUMMARY OF THE INVENTION

These and other objects are achieved in accordance with an illustrative embodiment of the present invention by establishing a recording mannequin which produces electrical signals substantially representative of the sound pressure which would be incident on a listener's eardrums and by establishing a receiver unit for use as an earphone in a stereophonic headset which includes acoustic impedance matching to provide a virtually flat frequency response at the listener's eardrum. More specifically, the recording mannequin utilized in the practice of an illustrative embodiment of this invention includes a physical replica of a human head and preferably the upper torso area and also includes acoustic and electroacoustic models of typical ear canals and eardrums. The electroacoustic models of the eardrums each includes a recording microphone, thus producing electrical output signals which are substantially representative of the sound pressure which would be incident on the eardrums of a person occupying the physical position of the recording mannequin.

The earphone or receiver of a typical embodiment of the present invention basically comprises a tubular housing which is substantially closed on one end and adapted for insertion into the ear canal on the other end, with an electroacoustic motor element mounted in the closed end portion of the housing. An acoustic resistance element having substantially the same resistance value as the characteristic impedance of a human ear canal is mounted within the housing near the end which is inserted in the ear canal and acoustic impedance matching means such as a cavity of predetermined volume is established between motor element and acoustic resistance so as to effectively drive the acoustic resistance element from an ideal pressure source. In addition, to further improve performance, one disclosed embodiment includes a second acoustic resistance element mounted in spaced juxtaposition with the diaphragm of the motor element and a second spatial volume between the first resistive element and the portion of the housing which is inserted in the ear canal. These elements respectively dampen high frequency resonances and compensate for the inductive impedance component normally associated with the first acoustic resistance element.

An electrical equalizing network, which can be included in the practice of this invention to facilitate the reproduction of conventionally recorded sound with the subject earphones without loss of fidelity, is also disclosed. This equalizing network filters the conventional programming to produce a signal which is substantially identical to that which would have been produced by the recording mannequin when located directly in front of the original sound source.

BRIEF DESCRIPTION OF THE DRAWINGS

FIG. 2 illustrates the electrical network which is analogous or equivalent to the depicted receiver and auditory tract;

DETAILED DESCRIPTION

Figure 1:
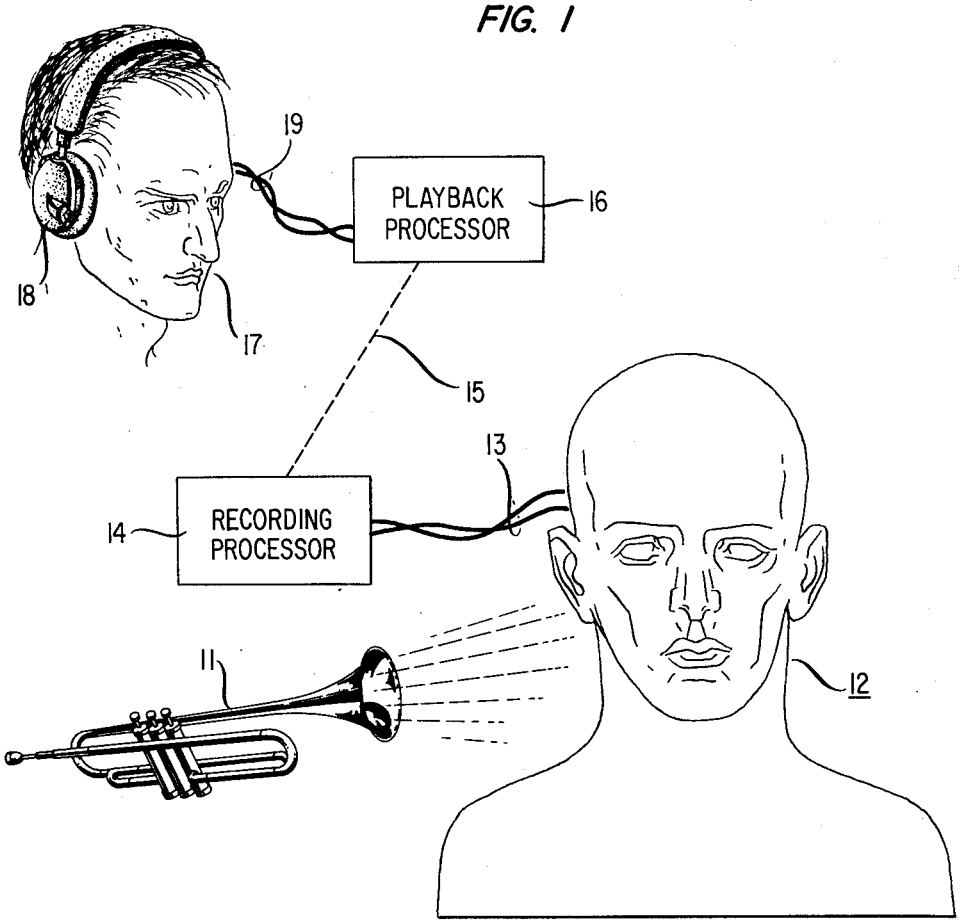
FIG. 1 illustrates a sound recording and reproduction system in accordance with the practice of this invention.

FIG. 1 is a diagram of a sound reproduction system illustrating the broader aspects of this invention. The sound field to be recorded is represented in FIG. 1 by a single musical instrument 11. Sound which reaches recording mannequin 12 is converted to a stereophonic electrical signal and transmitted to recording processor 14 via cable 13. Recording processor 14 can be any device which processes the signal for transmission to a listener. For example, processor 14 can be recording apparatus for making phonograph records or tape recordings for later distribution, or processor 14 can be a broadcasting system for transmitting the signal by radio wave or wire conductor, e.g., a conventional FM stereo multiplex broadcast system. In any case, the recorded signal is transmitted to the eventual listener via distribution link 15, which, of course, is any suitable means for distribution of the recording or other representation created by the particular processor 14. Playback processor 16 is any convenient device which converts the output of recording processor 14 into electrical signals which are substantially identical to those produced by recording mannequin 12. Thus, in a system in which recording processor 14 produces stereophonic tape recordings, playback processor 16 would be a conventional stereophonic tape playback mechanism. The recorded programming is presented to listener 17 by means of headset 18 which is connected to recording processor 16 by wires 19.

It can be noted that FIG. 1 is representative both of the previously described prior art system and of a system in accordance with the present invention. In the prior art system, recording mannequin 12 is merely a replica of the external human body and the recording or pickup microphones are either supported externally at the location of the mannequin's ears or, alternatively, are recessed in the mannequin head in place of models of the human ear. Additionally, prior art headset 18 is a conventional stereophonic headset which generally includes a pair of miniature loudspeakers mounted in a manner such that they will be supported adjacent the listener's outer ear, or pinna. In contrast, it will be realized upon understanding the following paragraphs that in the subject invention recording mannequin 12 includes an acoustic model of the human auditory tract such that the electrical signal coupled to recording processor 14 is representative of the sound pressure which would be exerted on the eardrums of an actual human listener occupying the position of recording mannequin 12. In order to re-create the recorded sound pressure at the eardrums of listener 17, headset 18, in accordance with one aspect of this invention, utilizes transducers or receiver units which include acoustic impedance matching elements which effect a flat frequency response at the listener's eardrums.

Performance of a system in accordance with this invention is markedly superior to the performance of the described prior art system, and listener 17 is often able to ascertain the position of the sound source with respect to the recording mannequin, even when the originating sound source is directly above or directly behind recording mannequin 12. Such an improvement in directionality, of course, imparts a sense of extreme realism in the reproduced sound which not only results in increased enjoyment of recorded musical programming, but also results in a higher degree of intelligibility where the reproduced sound is speech which originated in a noisy environment or in a situation in which several speakers are engaging in a fast-paced conversational exchange in which more than one speaker may be talking simultaneously.

Figure 2:
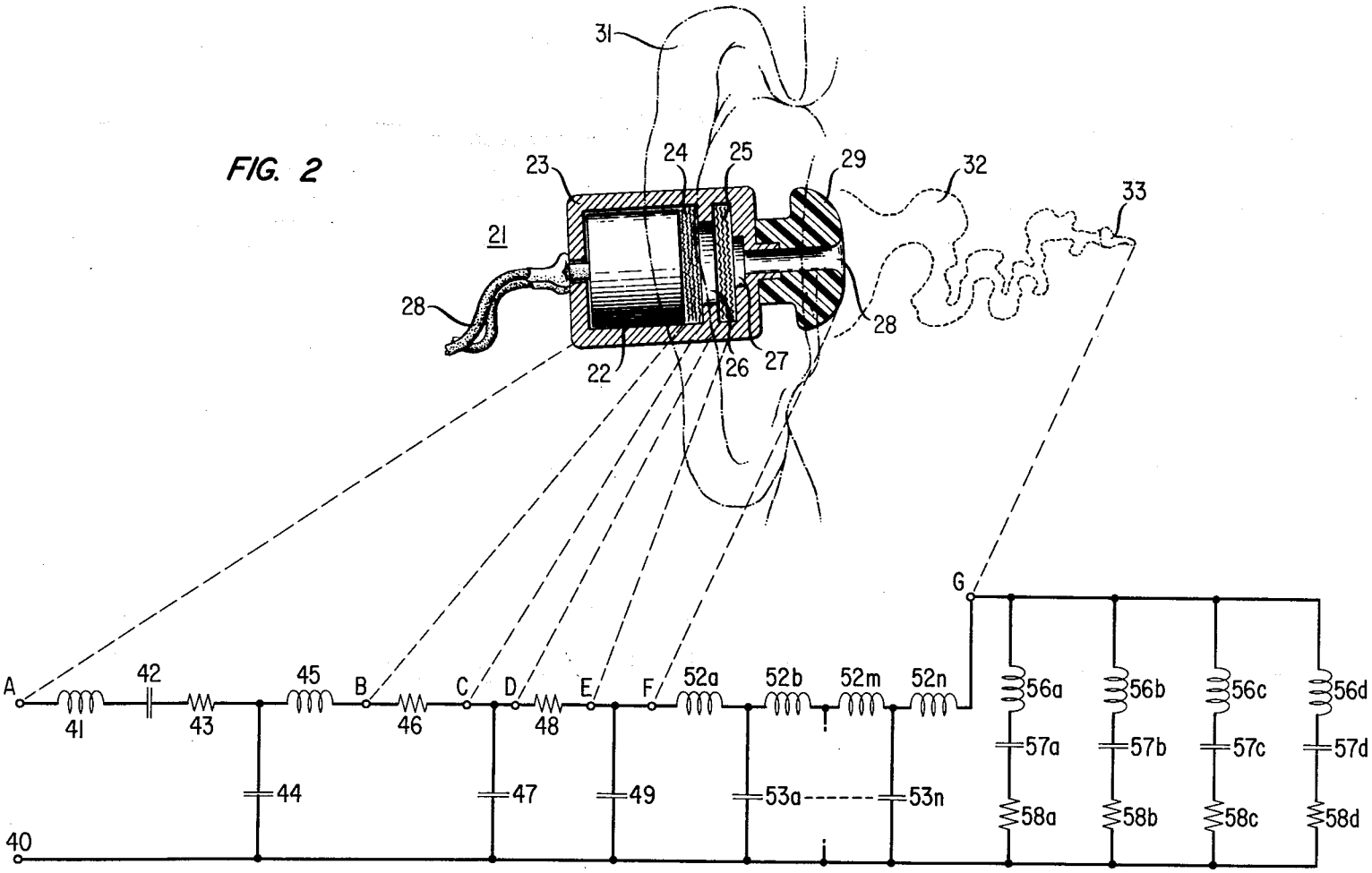
FIG. 2 is a cutaway view of an illustrative embodiment of a receiver or earphone constructed in accordance with this invention and a cross-sectional view of the listener's auditory tract. Additionally.

FIG. 2 depicts a cutaway view of a single transducer or receiver unit in accordance with a typical embodiment of this invention and a cross-sectional view of the listener's auditory tract. For convenience, the headset structure which supports the receiver on the listener's head is not shown. Motor element 22 of receiver 21 is a small electroacoustic transducer element which converts the electrical signal supplied via wires 28 into an acoustic output signal. In one embodiment, motor element 22 is a Western Electric Company 640AA condenser microphone which is widely used for precise acoustic measurements. It should be noted, however, that a variety of transducer elements can be employed. Motor element 22 is retained within one end of housing 23, with the diaphragm thereof facing the listener's ear. Acoustic resistance 24 is mounted in juxtaposition with the diaphragm of motor element 22. Acoustic resistance 24 may be any material exhibiting the desired acoustic resistance which can be mounted across the inner diameter of housing 23. Many materials which exhibit an acoustic resistance are known in the art. One such material which has been found to be suitable for the practice of this invention is a woven metallic twill or wire cloth which is commercially known as Michigan Dynamics Company 60–700 wire cloth. A second acoustic resistance element 25 which can comprise layers of wire cloth is supported within the housing at a fixed distance from first resistance element 24. The diameter of the housing between first resistance element 24 and second resistance element 25 is established such that a fixed spatial volume or acoustic compliance 26 is contained between the resistance elements. A second acoustic compliance 27 is established between second resistance element 25 and eartip 29 which is a compliant member formed to effect a relatively good seal with the opening to the listener's ear canal.

As is shown in FIG. 2, receiver unit 21 is supported adjacent the listener's outer ear or pinna 31 and the sound produced by motor element 22 passes through first resistive element 24, first acoustic compliance 26, second acoustic resistance element 25, and second compliance 27. The sound waves, which at this point have been effectively filtered to produce a flat frequency response at the listener's eardrum, then pass through tubular opening 28 in eartip 29, thereby being directly introduced into ear canal 32 and coupled to eardrum 33.

FIG. 2 further depicts an electrical network which is an electrical analogue of the electroacoustic system depicted in FIG. 2. The analogy between acoustic and electrical systems is well known to those skilled in the art and is advantageously employed in both the design and analysis of acoustic systems. As is shown in FIG. 2, the portion of the electrical network to the right of circuit node F represents the listener's auditory tract. This circuit representation is based on extensive experimental measurements to determine the dimensions of the ear canal and the acoustic impedance of the human eardrum conducted by J. J. Zwislocki which were reported in *An Ear-Like Coupler for Earphone Calibration*, Laboratory of Sensory Communication, Syracuse University, Syracuse, New York, Special Report, LSC-S-9 April 1971. The electrical analogue of the eardrum is the network consisting of four parallel resonant circuit branches, each circuit branch including series connected inductor 56, capacitor 57, and resistor 58. The ear canal is represented in FIG. 2 by the electrical network between circuit nodes F and G which includes inductors 52 and capacitors 53. This circuit will be recognized as representative of a lossless electrical transmission line. Zwislocki's research shows that the eardrum is satisfactorily represented by a network in which inductors 56*a*, 56*b*, 56*c*, and 56*d* are respectively 600, 180, 70, and 10 millihenries, capacitors 57*a*, 57*b*, 57*c*, and 57*d* are respectively 0.7, 0.12, 0.12, and 0.15 microfarads, and resistors 58*a*, 58*b*, 58*c*, and 58*d* are respectively 400, 400, 450, and 300 ohms. This research has further shown that the ear canal can be represented by a ten-section lumped equivalent transmission line circuit where each inductor 52 is substantially equal to 0.295 millihenries and each capacitor 53 is substantially equal to 0.0674 microfarads, thereby establishing a characteristic impedance of approximately 92 ohms.

Turning now to the portion of FIG. 2 which represents the electrical analogue of receiver 21, the network between circuit nodes A and B is the equivalent electrical circuit of motor element 22. For purposes of illustration, the network depicted in FIG. 2 corresponds to the previously mentioned WE 640AA condenser microphone which has satisfactorily been employed in embodiments of this invention. As shown in FIG. 2, this microphone has an electrical analogue which comprises inductor 41, capacitor 42, resistor 43, and inductor 45, which are series connected between nodes A and B and capacitor 44 which is connected between common terminal 40 and the junction between resistor 43 and inductor 45. It has been determined that the WE 640AA microphone can be satisfactorily represented by the portion of the circuit of FIG. 2 between circuit nodes A and B where inductor 41 is 4.54 millihenries, capacitor 42 is 0.08333 microfarads, resistor 43 is 263 ohms, capacitor 44 is 0.1388 microfarads, and inductor 45 is 0.7 millihenries.

Resistor 46, connected between circuit nodes B and C, is the electrical analogue of first acoustic resistance 24. This resistance element dampens a small resonant peak at approximately 20 kHz. It should be noted that the performance of receiver unit 21 will be satisfactory for many applications without the dampening effect introduced by resistive element 24. Thus, resistive element 24 need only be included in the most exacting applications.

Spatial volume 26, which creates the first acoustic compliance, is represented by capacitor 47 which is connected between common node 40 and commonly connected circuit nodes C and D. First acoustic compliance 26 is functionally an impedance matching element which effectively transforms the impedance of motor element 22 in order to drive first acoustic resistance element from an impedance lower than the impedance of the ear canal. Ideally this impedance matching element transforms the impedance of motor element 22 to approximate a constant pressure source. Since the impedance of the depicted WE 640AA condenser microphone is capacitive and greater in magnitude than the resistance of acoustic resistance element 25, acoustic compliance 26 is effective in performing the necessary impedance matching or transformation. In one embodiment of this invention which utilized the WE 640AA condenser microphone, an acoustic compliance 26 having a volume of approximately 1.5 cubic centimeters was found satisfactory. In embodiments which employ another type motor element 22, those skilled in the art will readily recognize impedance matching means which will effect the transformation of the impedance of a particular motor element to a low impedance for driving resistance element 25.

Resistor 48 connected between circuit nodes D and E, represents second acoustic resistance 25. Acoustic resistance 25 is constructed such that the analogous electrical resistance of resistor 48 is substantially identical to the characteristic impedance of the lossless transmission line analogue of the ear canal, that is, the approximately 92 ohm characteristic impedance of the network which includes inductors 52 and capacitors 53. Capacitor 49, connected between common terminal 40 and the commonly connected circuit nodes E and F, represents the acoustic compliance of second spatial volume 27. This element compensates for small, high frequency resonant peaks which are caused by the parasitic inductance of second acoustic resistance 25. Since the small resonant peaks only effect slight performance degradation at frequencies above 10 kHz, spatial compliance 27 can be eliminated in some embodiments.

Figure 3:
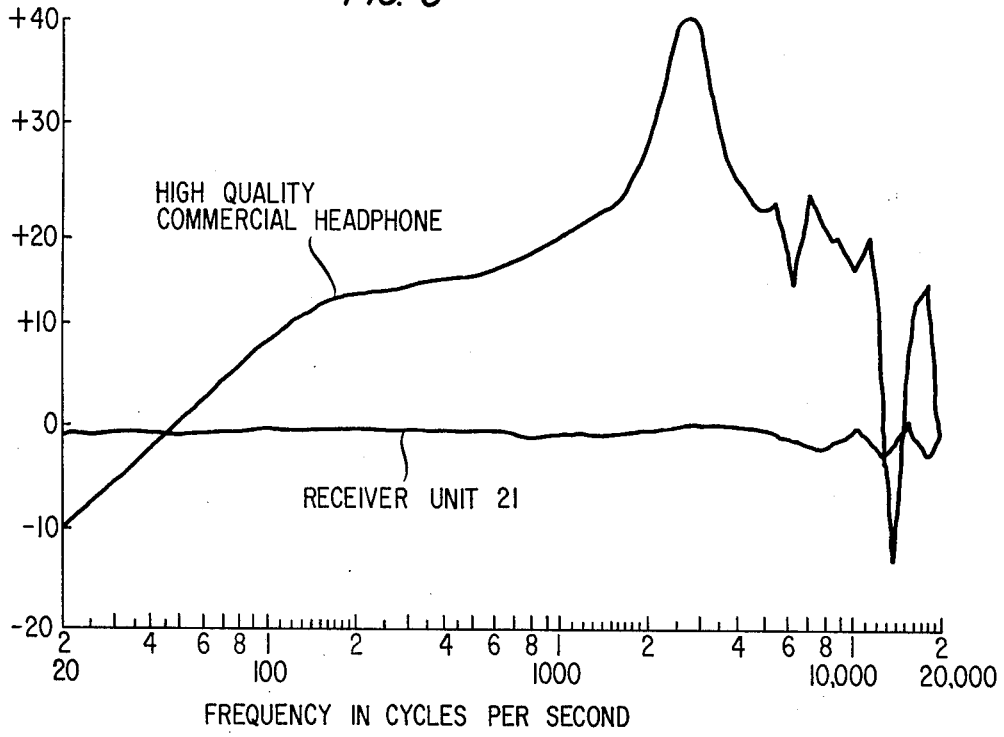
FIG. 3 illustrates the frequency response of a typical embodiment of a transducer constructed in accordance with this invention with respect to the signal induced at a listener's eardrum and additionally depicts the corresponding frequency response of a commercial high-quality stereophonic headset.

FIG. 3 depicts the frequency response of a receiver unit constructed in accordance with a typical embodiment of this invention, e.g., the receiver of FIG. 2. The data depicted in FIG. 3 is the ratio of the sound pressure developed at the listener's eardrum for a constant voltage electrical input to the receiver unit of FIG. 2. To provide a convenient contrast, the corresponding response of a prior art high-quality commercial stereo headset is also illustrated. As can be noted in FIG. 3, the frequency response of the receiver of FIG. 2 is essentially flat throughout the frequency range. The frequency response of the commercial headset, although due in part to the resonances of the auditory tract, also illustrates the general inability of prior art headsets to effect a reliable seal between the headset and the listener's ears, a deficiency which generally results in losses at low frequencies. The frequency response curve for the commercial headset also illustrates resonances which occur because such prior art headset receiver units are not acoustically matched to the environment created by the headset receiver cup and the listener's ear.

Figure 4:
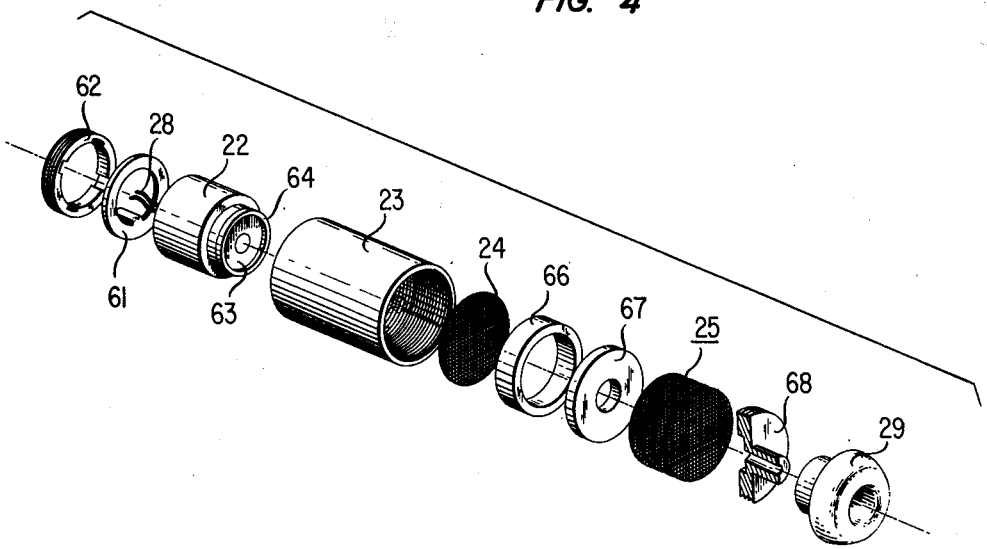
FIG. 4 is an exploded view of a receiver unit constructed in accordance with an illustrative embodiment of this invention.

FIG. 4 depicts an exploded view of one embodiment of a receiver unit constructed in accordance with this invention, thereby depicting one manner in which such a receiver unit can be assembled. For convenience, elements common to FIGS. 2 and 4 are denoted by the same identifiers.

In FIG. 4, housing 23 is a tube, preferably of metal, which is internally threaded. The inner diameter of housing 23 is slightly greater than the diameter of motor element 22 which, during assembly, is placed inside housing 23. Contact ring 61 is an optional metal washer with a tab formed at right angles to the inner diameter thereof. Contact ring 61 can be used as one of the two electrical connections to motor element 22 and is also useful in applications in which it is desirable to connect the motor element housing and tubular housing 23 to ground potential to thereby provide electrostatic shielding of motor element 22. End plate 62, which is threaded so as to mate with the interior threads of housing 23, is screwed into housing 22 to hold contact ring 61 in electrical contact with the housing of motor element 22 and to retain motor element 22 in a fixed position within housing 23. First acoustic resistance 24 is a disc-shaped single layer of acoustically resistive material, e.g., wire twill, which is slightly smaller than the inner diameter of housing 23. In the depicted embodiment, resistive element 24 is placed inside housing 23 and is maintained in spaced juxtaposition with diaphragm 63 of motor element 22 by the motor element diaphragm clamping ring 64. The first spatial volume for acoustic compliance 26 of FIG. 2 is formed by ring 66 and washer 67 which are placed inside of housing 23 in contact with one another and acoustic resistance element 24. In one embodiment, the volume defined by ring 66 was approximately 1.5 cc. and washer 67 was 0.06 inches thick, with a 0.214 inner diameter. Second acoustic resistance 25 is an acoustic resistance which is sufficient to establish an electrical analogue resistance substantially identical to the characteristic impedance of the ear canal. For example, four layers of the previously mentioned Michigan Dynamics Company 60–700 wire twill has been found to provide the desired resistance of approximately 92 ohms.

End cap 68 is threaded on its outer surface so that it can be screwed securely into housing 23 to firmly retain ring 66, washer 67, and resistive elements 24 and 25 in their respective positions. End cap 68 is recessed or counterbored on that surface adjacent to acoustic resistance 25 so as to establish second spatial volume or acoustic compliance 27 of FIG. 2. In addition, end cap 68 includes a short neck or length of tube mounted away from resistive element 25. This tube retains eartip 29, which is similar to the replaceable eartips used on the headsets of commercial airline passenger entertainment systems and can be made of soft plastic or rubber. In the embodiment of the receiver unit shown in FIG. 4, satisfactory performance was achieved by counterboring end cap 68 0.03 inches deep with a 0.375 diameter hole and by establishing the inner diameter of the tube of end cap 68 at 0.294 inches, which is the approximate diameter of the human ear canal.

It will be understood that the structure of FIG. 4 depicts but one structure for, and one method of, constructing a receiver unit in accordance with this invention and that many variations may be employed without departing from the spirit of this invention. For example, first acoustic compliance 26, which is formed by ring 66 and washer 67, could be realized by a single cup-like element and, as previously mentioned, the structure of element 26 can be adapted to match the impedance of virtually any motor element 22. Additionally, internal clamp rings could be utilized in place of the mating threads of housing 23 and plate 62 and end cap 68. Moreover, as previously mentioned, alternative porous materials are available which can be utilized as acoustic resistance elements.

Figure 5:
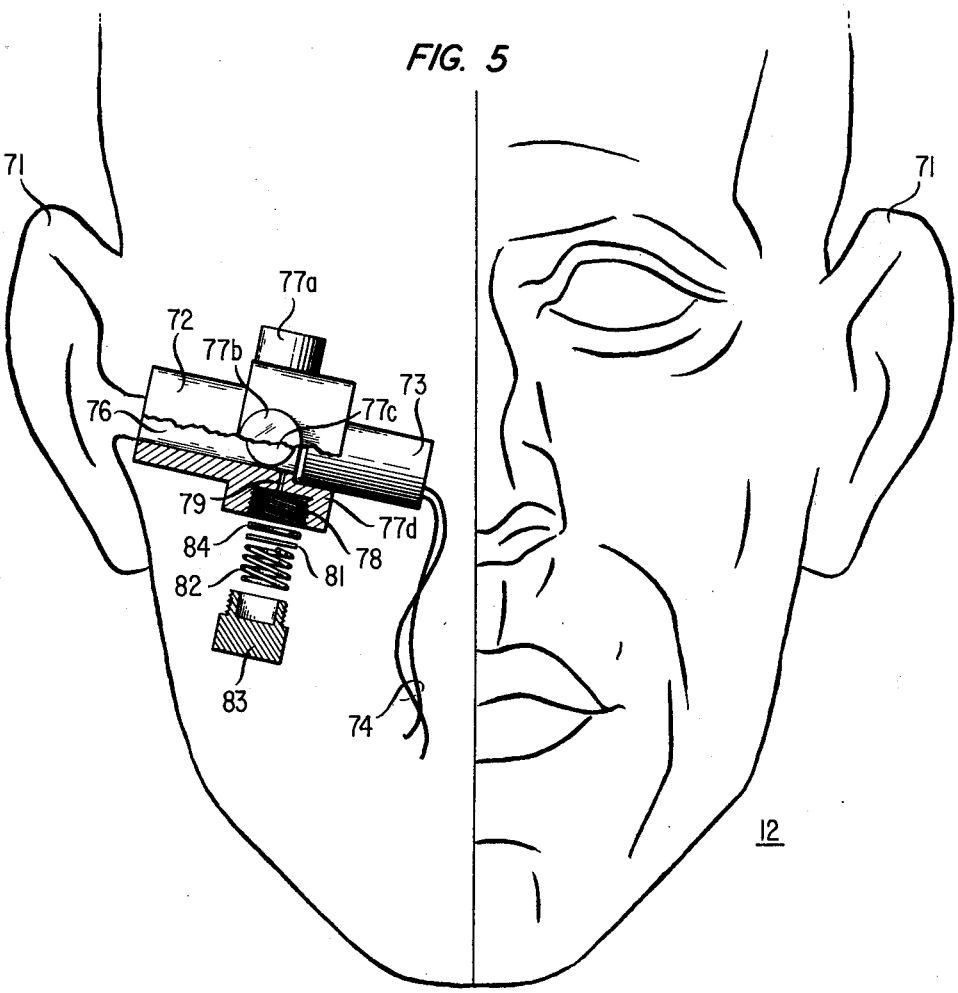
FIG. 5 depicts the structural details of a recording mannequin useful in the practice of this invention.

FIG. 5 depicts the internal details of a recording mannequin suitable for the practice of this invention. In FIG. 5, recording mannequin 12 is equipped with external ears or pinnae 71 which are molded of a compliant plastic or rubber-like material to substantially duplicate the external ears of a human being. The opening to each ear 71 is connected to acoustic network 72 which is similar to the ear canal and eardrum portions of the previously mentioned Zwislocki ear-like coupler mechanism. Acoustic network 72 is adapted for retaining microphone 73 at the end thereof which is opposite the ear opening and the electrical signal representing the recorded acoustic signal is coupled to the recording equipment, e.g., recording processor 14, via microphone wires 74. Acoustic network 72 includes a tubular passageway 76 which extends from the opening in molded pinna 71 to the face of microphone 73. This tube is dimensioned to provide the analogous electrical transmission line depicted in FIG. 2 and thereby provide an acoustic impedance which corresponds to a typical human ear canal. For example, in one embodiment of recording mannequin 12, a tubular passageway 76 which was 2.25 centimeters long and 0.75 centimeters in diameter was found satisfactory.

an acoustic impedance corresponding to the eardrum impedance is effected by four acoustic resonators 77*a*, 77*b*, 77*c*, and 77*d* which are perpendicular to the center line of passageway 76 and are spaced at 90° intervals on the periphery of passageway 76.

Each acoustic resonator 77 realizes one of the resonant circuit branches of FIG. 2 which comprise an inductor 56, a capacitor 57, and a resistor 58. To illustrate one method of constructing acoustic resonator 77, resonator 77*d* is shown in an exploded cross-sectional view in FIG. 5. Cavity 78 is connected to passageway 76 by opening 79 which is a small hole drilled through the wall of passageway 76. A disc of acoustic resistance material 81 which is dimensioned to provide the proper resistance as described in the discussion of FIG. 2 is inserted in cavity 78 and is spaced away from opening 79 by spacing washer 84. Resistive disc 81 is held in position by sping 82 and cap 83. As is shown in FIG. 5, one convenient method of constructing cap 83 so as to maintain the proper volume in cavity 78 is to construct cap 83 as a partially hollow bolt which is threaded to mate with threads on the walls of cavity 78. Regardless of the physical construction of resonators 77, each resonator (77*a*, 77*b*, 77*c*, and 77*d*) is constructed to effect a particular one of the four analogous electrical resonant circuits of FIG. 2 which comprise inductors 56, capacitors 57, and resistors 58. Although those skilled in the art will realize that many structural variations can be utilized to effect an acoustic network 72 which corresponds to the analogous electrical network of the auditory tract depicted in FIG. 2, the network depicted in FIG. 5 is advantageous because of its structural simplicity.

Although a headset which utilizes a pair of receivers 22 is best utilized when the acoustic programming of interest has been recorded by a mannequin 12 which contains the described acoustic network 72, there are many occasions on which it may be desirable to utilize the receiver units of this invention for playback of conventionally produced or recorded programming. It would be advantageous, for example, if stereophonic music recorded by the conventional open microphone process could be played back on a headset constructed in accordance with this invention. It has been found that an electrical equalizer network which provides wave shaping or filtering of the programming basically equivalent to the acoustical filtering of the human auditory tract when listening to sounds coming from straight ahead not only tends to preserve the fidelity of the conventional programming, but often results in the listener experiencing an increased sense of presence with respect to the originating sound field.

Figure 6:
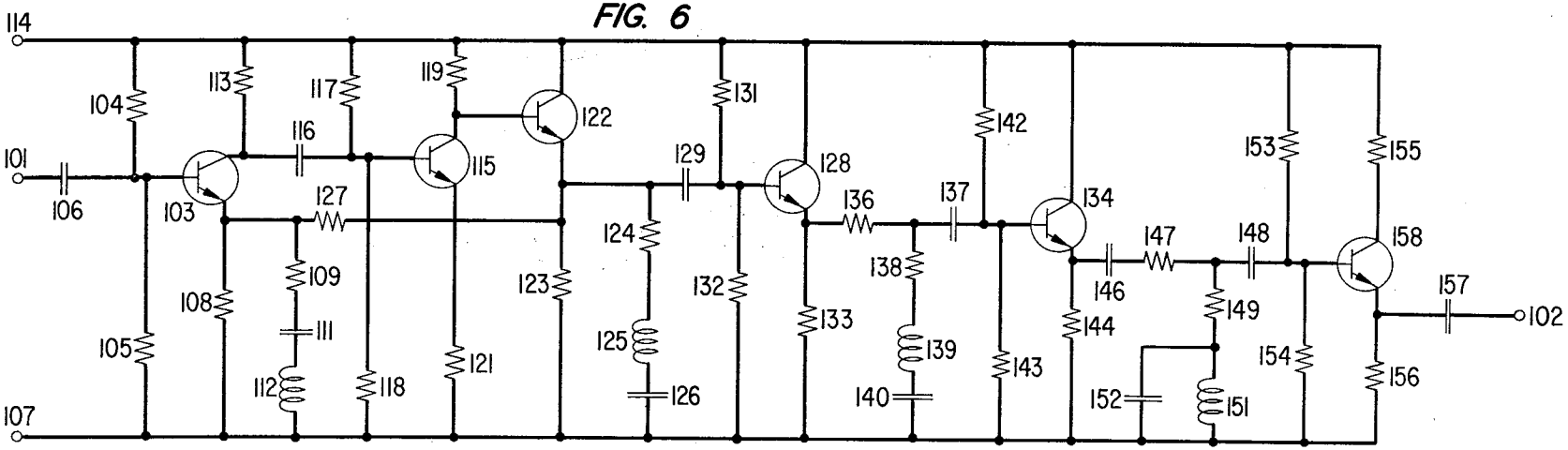
FIG. 6 is a schematic diagram of a typical equalizer network useful in the playback of conventionally recorded sound with the receiver unit of FIGS. 2 and 4.

One embodiment of an equalizer network suitable for use with this invention is depicted in FIG. 6. In operation, an equalizer network such as that illustrated in FIG. 6 is connected between playback mechanism 16 and each receiver 21 of headset 18 of FIG. 1, with each equalizer input terminal 101 connected to the output terminals of playback unit 16 and output terminal 102 connected to the input terminal of one receiver 21 in headset 18. Referring to the equalizer network schematically depicted in FIG. 6, it can be seen that the circuit basically comprises four cascaded tuned amplifier stages. The base electrode of transistor 103 is connected to input terminal 101 by capacitor 106 and bias is provided for transistor 103 by resistors 104 and 105 which are series connected between bias terminals 114 and 107, with the junction of resistors 104 and 105 connected to the base electrode of transistor 103. The emitter electrode of transistor 103 is connected to bias terminal 107 by means of resistor 108 which is connected in parallel with a tuned circuit branch including series connected resistor 109, capacitor 111, and inductor 112. The collector electrode of transistor 103 is connected to bias terminal 114 via resistor 113, and is also connected to the base electrode of transistor 115 by capacitor 116. Bias for transistor 115 is provided by resistors 117 and 118 which are series connected between bias terminals 114 and 107, with the junction between resistor 117 and resistor 118 connected to the base electrode of transistor 115. The collector electrode of transistor 115 is connected to bias terminal 114 by resistor 119 and the emitter electrode of transistor 115 is connected to bias terminal 107 by resistor 121. The collector electrode of transistor 122 is connected to bias terminal 114 and the base electrode of transistor 122 is connected to the collector electrode of transistor 115. The emitter electrode of transistor 122 is connected to bias terminal 107 by resistor 123 which is connected in parallel with the tuned circuit branch including resistor 124, conductor 125, and capacitor 126. In addition, the emitter electrode of transistor 122 is connected to the emitter electrode of transistor 103 by feedback resistor 127 and is further connected to the base electrode of transistor 128 by coupling capacitor 129. Bias for transistor 128 is provided by resistors 131 and 132 which are series connected between bias terminals 114 and 107, with the junction between resistors 131 and 132 connected to the base electrode of transistor 128. The collector electrode of transistor 128 is connected to bias terminal 114 and the emitter electrode of transistor 128 is connected to bias terminal 107 by resistor 133. The emitter electrode of transistor 128 is also connected to the base electrode of transistor 134 by series connected resistor 136 and capacitor 137. A series connected circuit branch including resistor 138 and inductor 139 and capacitor 140 is connected from the junction of resistor 136 and capacitor 137 to bias terminal 107. Transistor 134 is biased by resistors 142 and 143 which are series connected between bias terminals 114 and 107, with the junction of resistors 142 and 143 connected to the base electrode of transistor 134. The collector electrode of transistor 134 is connected to bias terminal 114 and the emitter electrode of transistor 134 is connected to bias terminal 107 by resistor 144. The emitter electrode of transistor 134 is also connected to the base electrode of transistor 158 by a series connected circuit branch including capacitor 146, resistor 147, and capacitor 148. The junction of resistor 147 and capacitor 148 is connected to bias terminal 107 by series connected resistor 149 and inductor 151, with capacitor 152 connected in parallel with inductor 151. Transistor 158 is biased by resistors 153 and 154 connected in series between bias terminals 114 and 107, with the junction between resistors 153 and 154 connected to the base electrode of transistor 152. The collector electrode of transistor 158 is connected to bias terminal 114 by resistor 155 and the emitter electrode of transistor 158 is connected to bias terminal 107 by resistor 156. The emitter electrode of transistor 158 is also connected to output terminal 102 by capacitor 157.

The equalizer circuit of FIG. 6 is designed to establish resonant peaks in the transfer characteristics at approximately 12 kHz and 3 kHz and to establish antiresonant dips in the transfer characteristic at approximately 7.5 kHz and 1.5 kHz. The 12 kHz resonance is primarily established by capacitor 111 and inductor 112. The 3 kHz resonance is primarily established by inductor 151 and capacitor 152, and the 7.5 and 1.5 kHz dips are established respectively by the combination of inductor 125 and capacitor 126 and the combination of inductor 139 and capacitor 140.

Figure 7:
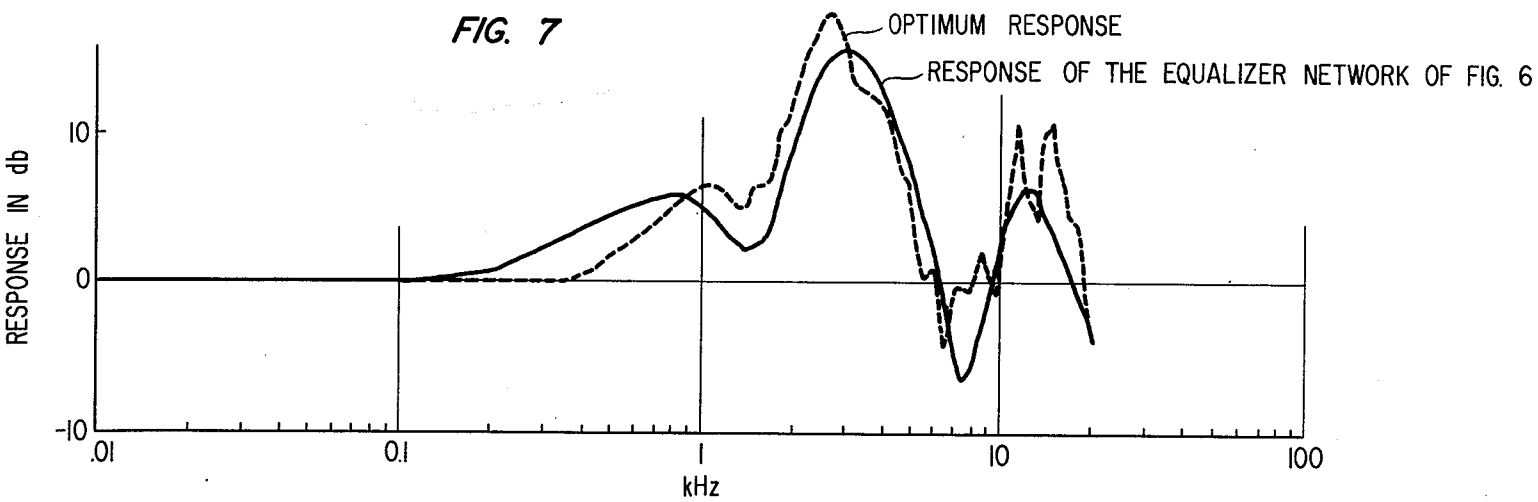
FIG. 7 depicts the frequency response or transfer characteristics of the equalizer network of FIG. 6 and further illustrates the optimal frequency response of an equalizer for use in the playback of conventionally recorded sound with the receiver units of FIGS. 2 and 4.

FIG. 7 depicts the frequency response or transfer characteristics of the equalizer circuit of FIG. 6 and also depicts the optimum response characteristics of an equalizer for use with the receivers of FIGS. 2 and 4 for playback of conventionally recorded programming. The optimum response curve represents the transfer characteristics of the human auditory tract and thus the transfer characteristics of recording mannequin 12 when the listener or mannequin 12 is located directly in front of the sound source. It will be recognized by those skilled in the art that the equalizer circuit of FIG. 6 is merely representative of a variety of equalizer networks which can be constructed to approximate the optimum characteristics depicted in FIG. 7 and that a variety of circuit synthesis or filter design techniques can be utilized to design an equalizer network having the transfer characteristics depicted in FIG. 7.

What is claimed is:

1. An in-ear receiver for effecting a substantially flat frequency response at a user's eardrum comprising:

an electroacoustic motor element for supplying an acoustic signal in response to a supplied electrical signal;

a hollow housing adapted for retaining said motor element at one end thereof;

acoustic impedance matching means for transforming the impedance of said electroacoustic motor element so that said transformed impedance is below the impedance of the user's ear canal, said impedance matching means mounted within said hollow housing adjacent to said motor element;

an acoustic resistance mounted within said hollow housing adjacent to said impedance matching means, said acoustic resistance substantially identical to said characteristic impedance of said user's ear canal; and end plate means mounted across the end of said hollow housing adjacent to said acoustic resistance, said end plate means adapted for insertion in the outer opening of said user's ear canal, said end plate including an orifice for acoustically coupling the signals produced by said electroacoustic motor element to said ear canal.

2. An in-ear receiver unit for effecting substantially flat frequency response at a listener's eardrum comprising:

an electroacoustic motor element for developing an acoustic signal in response to an applied electrical signal;

a hollow housing with the first end thereof adapted for retaining said electroacoustic motor element;

a first acoustic resistance element mounted within the second end of said hollow housing, the resistance of said first acoustic resistance element substantially equal to the nominal characteristic impedance of a human ear canal;

means for establishing a first predetermined spatial volume between said electroacoustic motor element and said first acoustic resistance;

and adapter means for adapting said second end of said hollow housing for insertion in the outer opening of said listener's ear canal, said adapter means including a tubular opening for the passage of acoustical signals into said ear canal.

3. The in-ear receiver unit of claim 2 further comprising a second acoustic resistance mounted in spaced juxtaposition with the diaphragm of said electroacoustic motor element.

4. The in-ear receiver unit of claim 3 further comprising means for establishing a second spatial volume of predetermined volume between said first acoustic resistance and said adapter means.

5. The in-ear receiver unit of claim 4 wherein said first and second acoustic resistances include at least one layer of a porous sheet material coextensive in area with the inside area of said hollow housing, said first and second acoustic resistance supported such that the surfaces of said resistances are substantially parallel to the diaphragm of said electroacoustic motor element.

6. An in-ear transducer acoustically matched to the impedance of the ear canal to provide substantially flat frequency response at the user's eardrum comprising:

an electroacoustic motor element for developing an acoustic signal in response to an applied electrical signal, said motor element having an acoustic impedance greater than the nominal acoustic impedance of said ear canal;

a tubular housing with one end thereof adapted to retain said electroacoustic motor element;

an acoustic resistance element including a plurality of layers of resistive sheet material mounted across the inner diameter of said tubular housing substantially parallel with the diaphragm of said motor element at a predetermined distance from said diaphragm;

a tubular ring having an outer diameter substantially identical to the inner diameter of said tubular housing and a length substantially identical to said predetermined distance between said motor element diaphragm and said acoustic resistance, said tubular ring mounted within said tubular housing between said motor element and said resistive element, the inner diameter of said tubular ring establishing a predetermined spatial volume between said motor element diaphragm and said acoustic resistance;

an end cap for closing said tubular housing, said end cap including a circular opening in the center thereof and a tubular extension on one face thereof in substantial alignment with said opening, said end cap mounted across the end of said tubular housing adjacent to said acoustic resistance, with said tubular extension facing away from acoustic resistance; and a compliant eartip retained on said tubular extension of said end cap for effecting an acoustic seal with the opening in said user's ear canal.

7. The in-ear receiver of claim 6 further comprising a second acoustic resistance including at least one layer of porous acoustic resistive sheet material mounted across said inner diameter of said tubular housing in close proximity with said diaphragm of said motor element.

8. The in-ear receiver of claim 7 wherein said end cap includes a circular cavity of predetermined diameter and predetermined depth substantially concentric with said circular opening, said cavity located in the face of said end cap away from said tubular extension.

9. The in-ear receiver of claim 8 wherein said resistive sheet material is a wire screen.

10. A stereophonic reproduction system comprising:

means for converting an incident acoustic field to electrical signals representative of the acoustic signals reaching the eardrums of a listener;

transmitter means for transmitting said electrical signals representative of the signals reaching said listener's eardrums to a remote location; and receiver means located at said remote location for converting said transmitted signals to an acoustic signal, the output impedance of said receiver means being acoustically matched to a listener's ear canal.

11. The stereophonic reproduction system of claim 10 wherein said means for converting an incident acoustic field to electrical signals includes a mannequin equipped with models of human pinnae, each pinna connected to an acoustic model of the human ear canal and eardrum, each of said acoustic models of an eardrum including a microphone.

12. The stereophonic reproduction system of claim 11 wherein said acoustic model of the human ear canal comprises a tubular passageway, and said acoustic model of said human eardrum further includes one or more acoustic resonant cavities.

13. In a stereophonic recording system including a recording mannequin equipped with recording microphones and means for processing the signal produced by said microphones for playback to a remote listener, the improvement comprising acoustic impedance means mounted within said recording mannequin for establishing the acoustic signal which impinges upon said microphones substantially identical to that acoustic signal which would reach the eardrums of a human listener occupying the same location as said recording mannequin.

14. The stereophonic recording system of claim 13 wherein said recording mannequin includes models of the human pinna, each pinna connected to one end of a tubular passageway representative of the human ear canal, the second end of each tube connected to an acoustic network representative of the human eardrum, said acoustic network including four parallel damped resonant acoustic circuits.

* * * * *